United States Patent [19]

Kessler et al.

[11] Patent Number: 4,796,399

[45] Date of Patent: Jan. 10, 1989

[54] COMBINATION WALK-OFF AND FATIGUE MAT

[75] Inventors: Ronald N. Kessler, Youngstown; Myron Ullman, Canfield; Milton Kessler, Youngstown, all of Ohio

[73] Assignee: Boardman Molded Products, Inc., Youngstown, Ohio

[21] Appl. No.: 110,313

[22] Filed: Oct. 20, 1987

[51] Int. Cl.[4] ..... E04F 19/10; A47L 23/22

[52] U.S. Cl. ..... 52/177; 52/663; 15/215; 15/217

[58] Field of Search ..... 15/161, 215, 237, 216, 15/217, 238, 239, 240, 241; 52/663, 177

[56] References Cited

U.S. PATENT DOCUMENTS

| | | | |
|---|---|---|---|
| 164,333 | 6/1875 | Roullier . | |
| 910,332 | 1/1909 | Mattie . | |
| 1,446,420 | 2/1923 | Goubier | 15/215 |
| 2,436,315 | 2/1948 | Liberatore | 15/112 |
| 2,777,789 | 1/1957 | Smith | 154/49 |
| 3,808,628 | 5/1974 | Betts | 15/215 |
| 4,164,599 | 8/1979 | Kessler | 428/92 |
| 4,637,948 | 1/1987 | Evans et al. | 428/85 |

FOREIGN PATENT DOCUMENTS

| | | | |
|---|---|---|---|
| 315898 | 7/1929 | United Kingdom | 15/215 |

*Primary Examiner*—James L. Ridgill, Jr.
*Attorney, Agent, or Firm*—Browdy and Neimark

[57] ABSTRACT

An improved combination walk-off and fatigue mat constitutes an improvement over the mat of U.S. Pat. No. 3,703,059 in the provision of three additional structural features, namely tertiary ribs which prevent the upper ribs from spreading apart and catching spiked heels, pile carpet strips to better clean the bottoms of wet shoes, and separately molded clip elements to mechanically hold the fabric pile strips in place between adjacent top ribs.

10 Claims, 2 Drawing Sheets

COMBINATION WALK-OFF AND FATIGUE MAT

FIELD OF INVENTION

The present invention relates to a combination walk-off and fatigue mat, and more particularly to an improvement of the extensible perforate floor mat and friction device of U.S. Pat. No. 3,703,059.

BACKGROUND OF THE INVENTION

The extensible perforate floor mat and friction device of the M. Kessler U.S. Pat. No. 3,703,059 has achieved immense success not only in the United States, but also abroad. It meets the needs for which it was originally designed, such as those expressly mentioned in said U.S. Pat. No. '059. Such a mat as disclosed in said '059 patent consists of a first series of equally spaced ribs held together by a second series of equally spaced supports molded below and at 90° to the first mentioned ribs. The spaced apart ribs of this mat provide a built-in drain for run off water. The upper spaced ribs support and scrape the shoes passing thereover. The construction provides a degree of softness to ease the load on tired feet and reduce the road shock of walking.

Other grid-like floor mats are known in the patent literature, and some combination mats including fibrous materials provided in certain areas are also known. There may be briefly mentioned the U.S. Pat. Nos. 3,808,628; to Betts Liberatore 2,436,315; Watti 910,332; Roullier 164,333; and Smith 2,777,789. These patented mats, however, suffer from a number of disadvantages including difficult and/or costly manufacture, insufficient cushioning, and/or poor wear properties, i.e. short lifetime; these deficiencies are not present in the mat of the aforementioned U.S. Pat. No. '059.

However, the mat of Kessler '059 does have certain deficiencies which have become apparent over the years. Thus, in wet applications ribs alone cannot scrape clean a wet shoe. Also, "spike" heels may begin to penetrate between the spaced upper ribs at a point roughly mid-distant between the spaced lower ribs, and as soon as this begins to happen the upper ribs may begin to spread apart so that the spike heel become wedged therebetween.

SUMMARY OF THE INVENTION

It is, accordingly, an object of the present invention to overcome deficiencies in the prior art, such as indicated above.

It is another object of the present invention to provide an improvement of the extensible perforate floor mat and friction device of Kessler U.S. Pat. No. 3,703,059, the contents of which are hereby incorporated by reference.

It is a further object of the present invention to provide an improved combination walk-off and fatigue mat consistent with the mat of U.S. Pat. No. 3,703,059, and which retains all of the advantages of said mat and provides further advantages as well.

It is still another object of the present invention to provide an improved mat which not only has the advantages of the mat of U.S. Pat. No. '059 but also can wipe the bottom of a shoe dry.

It is still a further object of the invention to provide an improved mat of the character of that disclosed in Kessler U.S. Pat. No. '059, but in which "spike" heels cannot wedge.

BRIEF DESCRIPTION OF DRAWING

The above and other objects and the nature and advantages of the instant invention will be more apparent from the following detailed description of certain specific embodiments, such embodiments being considered in conjunction with the accompanying drawing wherein.

DETAILED DESCRIPTION OF EMBODIMENTS

As indicated above, in wet applications, solid plastic or rubber ribs cannot alone scrape clean a wet shoe. In order to accomplish the drying of a wet shoe surface, some type of absorbent surface is required, such as a carpet-like surface. The well known carpet mats will wipe the shoe dry, but these have a short life and will not give the fatigue and scraping features necessary. Therefore, a mat with both ribs and carpet according to the present invention is ideal for the complete removal of dirt and water from shoe bottoms.

Thus, in accordance with the present invention each mat section 10 can comprise two main elements, namely an integrally molded main portion comprising three types of ribs 6, 7 and 9, and a plurality of separately formed carpet wiping strips 15, only one being illustrated in the disclosed embodiment. The carpet strips 15 may comprise common pile-type weatherstrip material, such as that disclosed in the Milton Kessler U.S. Pat. No. 4,164,599 and other patents as well, including those mentioned in the "Background" section of the aforementioned '599 patent.

With regard to the supporting resilient, integrally molded main mat portion itself, the ribs 6 and 9 correspond to those in the aforementioned Kessler U.S. Pat. No. '059, while the ribs 7 constitute novel added structure which will be described in more detail below.

Figure 2:
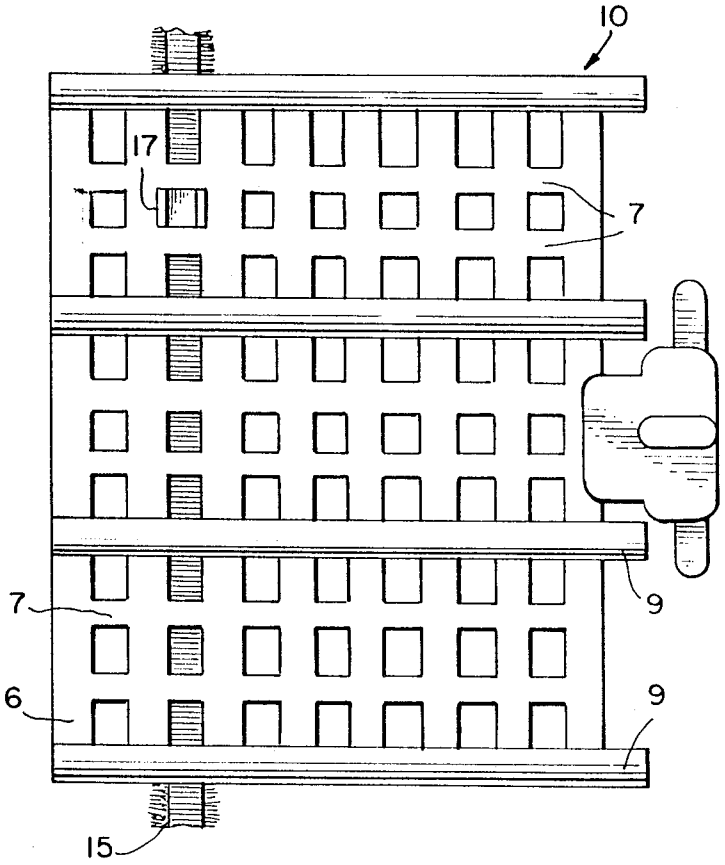
FIG. 2 is a bottom plan view of the same section of mat as shown in FIG. 1.
Figure 1:
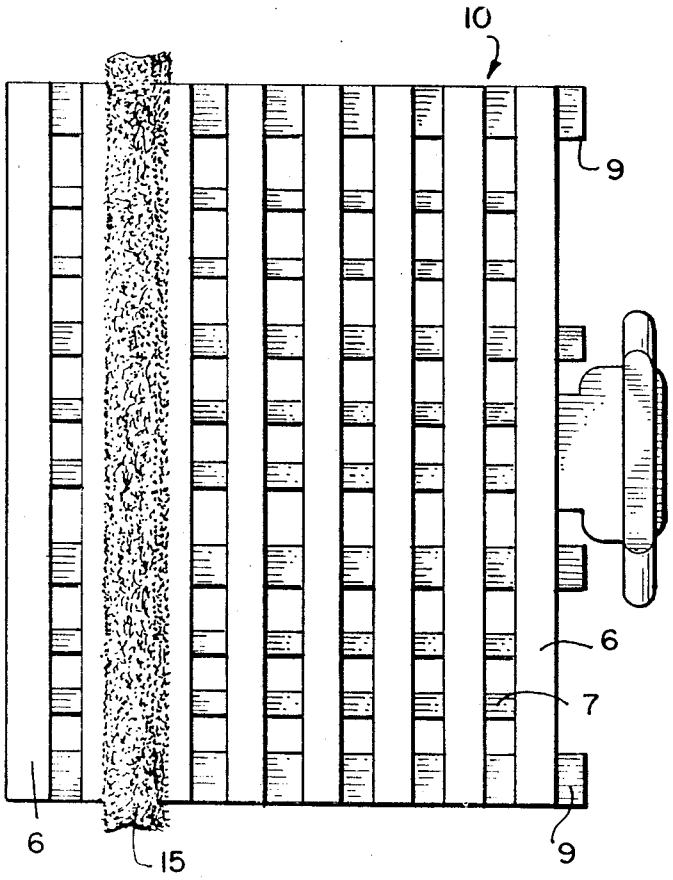
FIG. 1 is a top plan view of a section of mat in accordance with the present invention.

As can be best seen in FIGS. 1 and 2, the elongated carpet strips 15 are placed between adjacent upper ribs 6 and can fit tightly therebetween so as to be partially retained by friction. However, friction retention is not entirely adequate, and so the carpet strip should be provided with adhesive on its lower surface or be retained by other mechanical means such as a clip, one embodiment 17 of which is best shown in FIG. 3 as described below.

The height of the carpet strip pile can vary with respect to the height of the mat. In general, however, the top of the pile should extend slightly above the top of the ribs 6, desirably at least 0.1–0.25 inches above the top of the ribs 6. It will also be understood that the density, weave and yarn of the carpet pile can be selected from among the many possibilities available.

It is not necessary or economical to include a carpet strip 15 in every space between adjacent ribs 6. Accordingly, it is preferred that the strips 15 be located in every second, third or fourth space, such spacing being adequate to wipe moisture from shoes walking over the carpet strips. The number of strips can be varied over the length of the walking path across the mat. For example, a greater number of strips can be provided at the beginning of the mat and fewer at the end where any water would have already been wiped off.

Figure 3:
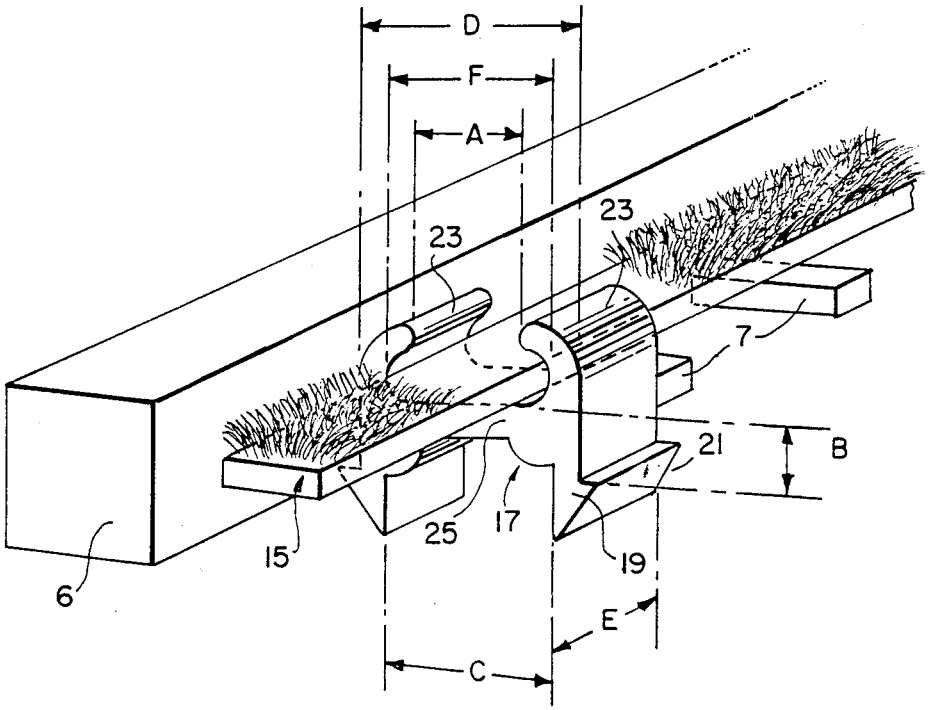
FIG. 3 is a partial perspective view, enlarged, of a portion of mat in accordance with the present invention, and showing a clip for maintaining in place a wiping strip.

In accordance with a preferred embodiment, the carpet strips 15 are desirably held between pairs of adjacent ribs 6 by means of suitable clips, most preferably H-shaped clips 17 as best shown in FIG. 3. Each clip 17 comprises downwardly depending legs 19 having outwardly extending teeth 21, upwardly extending arms 23 which curve inwardly, and a horizontal joining and supporting base 25. It will be understood that slot A between the ends of the curved arms 23 has to be just wide enough to pass the width of the pile. Dimension B constitutes the distance from the base of the pile strip to the bottom of the mat rib 6, and this distant B may be zero. Dimension C between the legs 19 provides clearance which enables the teeth 21 and legs 19 to flex inwardly when forced between the adjacent ribs 6, whereupon the teeth 21 then lock the clip 17 into place.

Dimension D which corresponds to the outer dimension of the arms 23 should be the same or only slightly smaller than the distance between the ribs 6. Dimension E, the length of the clip, can be practically any selected dimension. Dimension F is the width of the groove at the bottom of the arms 23 and should be as large as possible so that carpet strips of varying width can be used.

Use of the clip 17 provides a number of advantages. Thus, no capital expenditures for fastening equipment is necessary, and the clips may be affixed at any desired location. The carpet strips can be affixed to the mat at any site, e.g. The manufacturing plant, the distribution facility or at the final destination. As is seen from Kessler U.S. Pat. No. '059, the mats are made in sections and are assembled together to form a final product; another advantage of the invention is that use of long carpet strips provide another means for holding the various sections together.

Moreover, because of manufacturing realities, mats are not always exactly the same size when manufactured, and therefore a movable clip provides greater flexibility and reliability for providing the finally assembled product. The use of clips also permits the use of replacement carpet strips when the originals have become worn. The clip is also easily molded of plastic and functions well to secure the carpet strips to the mat.

As mentioned above, another difference between the present mat 10 and the mat of the aforementioned Kessler U.S. Pat. No. '059 is the provision in the present mat of the tertiary ribs 7. These tertiary ribs 7 extend parallel to the bottom support ribs 9 and therefore perpendicular to the upper ribs 6. The tertiary ribs 7 are relatively small both in width and height in order to limit the quantity of material used to form the mat, i.e. te height is desirably 0.125 inches, approximately half as great as the upper ribs 6 ed which are desirably about 0.25 inches high. As best seen in FIG. 3, the bottom surface of the tertiary ribs 7 are coextensive with the bottom surface of the upper ribs 6, and the upper surface of the tertiary ribs 7 also serve as supporting surfaces for the carpet strips 15.

In the mat of the aforementioned Kessler U.S. Pat. No. '059, the water drainage holes, defined by the through spaces between the crossing ribs 6 and 9, are much longer than they are wide, roughly in the proportion of 6 to 1. If a spike heel begins to penetrate into such a space, the ribs 6 will begin to spread apart and the spike heel will become wedged therebetween. However, the provision of the tertiary ribs 7 tends to dimensionally fix the ribs 6 at locations between the ribs 9 so that the ribs 6 cannot spread apart. Thus, in the present mat 10, a spike heel cannot penetrate between the upper ribs 6 because these ribs are prevented from being spread apart both by the tensile strength of the tertiary ribs 7 in the space in which the spike heel is attempting to penetrate, and also by the compressive strength of tertiary ribs 7 in adjoining gaps.

As can be clearly seen in FIGS. 1 and 2, it is suitable to provide a pair of rows of tertiary ribs 7 between a row of ribs 9, thereby converting a rectangular gap of approximately 6:1 into three almost square openings. As pointed out above, the tertiary ribs 7 are desirably made as small as possible because additional material reflects an additional cost both in material and mold fabrication.

It will be obvious to those skilled in the art that various other changes and modifications may be made without departing from the scope of the invention and the invention is not to be considered limited to what is shown in the drawings and described in the specification.

What is claimed is:

1. A combination walk-off and fatigue mat comprising a first series of parallel flexible top ribs spaced apart a distance approximately equal to their own width, a second series of parallel flexible bottom ribs underlying and crossing said top ribs and spaced apart at least twice the distance separating the top ribs, the ribs of the two series being integrally molded together at all points where they cross, and a third series of parallel ribs extending parallel to said second series of parallel bottom ribs and located therebetween, said third series of ribs overlying said second series of parallel flexible bottom ribs and projecting upwardly therefrom to a height less than the height of said first series of parallel flexible top ribs.

2. A floor mat according to claim 1 further comprising a plurality of pile carpet strips extending parallel to said top ribs, each being located between two adjacent top ribs.

3. A floor mat according to claim 2 wherein said pile strips project above the upper surface of said top strips, the bottoms of said carpet strips resting on the tops of said third series of ribs.

4. A floor mat according to claim 2 wherein said carpet strips are maintained in place adhesively.

5. A floor mat according to claim 2 wherein said carpet strips are held in place by clips.

6. A floor mat according to claim 5 wherein said clips are generally H-shaped with gripping teeth along the bottom thereof and curved arms along the top for grasping a carpet strip.

7. A combination walk-off and fatigue mat comprising a first series of parallel flexible top ribs spaced apart a distance approximately equal to their own width, a second series of parallel flexible bottom ribs underlying and crossing said top ribs and spaced apart at least twice the distance separating the top ribs, the ribs of the two series being integrally molded together at all points where they cross, and a series of separately formed pile fabric strips located between pairs of said first series of parallel top ribs and fixed therebetween, the tops of said pile fabric strips projecting upwardly above the tops of said first series of parallel top ribs.

8. A mat in accordance with claim 7 wherein said pile fabric strips are adhesively maintained between pairs of said first series of parallel top ribs.

9. A mat according to claim 7 wherein said pile fabric strips are mechanically maintained between adjacent pairs of said first series of parallel top ribs by separately formed plastic clips.

10. A mat according to claim 7 comprising a third series of parallel ribs extending parallel to said second series of parallel bottom ribs and spaced therebetween, said third series of ribs projecting above said series of bottom ribs and crossing said first series of top ribs and being of lesser height than said first series of parallel top ribs, said third series of parallel ribs being integrally molded together with said first series of parallel top ribs at all points where they cross.

* * * * *